US006386949B1

(12) United States Patent
Hagiwara et al.

(10) Patent No.: US 6,386,949 B1
(45) Date of Patent: May 14, 2002

(54) METHOD FOR CLEANSING/SCRAPING AND APPARATUS THEREFOR

(75) Inventors: Koichi Hagiwara; Jiro Watanabe; Kazuo Kishimoto; Hiroyuki Nakano, all of Ishikawa (JP)

(73) Assignees: Shibuya Kogyo Co., Ltd.; Shibuya Machinery Co., Ltd., both of Ishikawa (JP)

( * ) Notice: Subject to any disclaimer, the term of this patent is extended or adjusted under 35 U.S.C. 154(b) by 0 days.

(21) Appl. No.: 09/527,532

(22) Filed: Mar. 16, 2000

(30) Foreign Application Priority Data

Mar. 18, 1999 (JP) ..... 11-074627
Aug. 26, 1999 (JP) ..... 11-239395
Aug. 26, 1999 (JP) ..... 11-239396

(51) Int. Cl.[7] ..... B24C 5/04
(52) U.S. Cl. ..... 451/40; 451/75; 51/165.73
(58) Field of Search ..... 451/40, 75, 90, 451/39; 51/165.73, 165.74, 320, 410

(56) References Cited

U.S. PATENT DOCUMENTS 4,555,872 A * 12/1985 Yie ..... 451/40
4,583,329 A * 4/1986 Lang ..... 451/40
4,648,215 A * 3/1987 Hashish et al. ..... 451/40
5,065,551 A * 11/1991 Fraser ..... 451/40
5,599,223 A * 2/1997 Mains, Jr. ..... 451/40 X

FOREIGN PATENT DOCUMENTS

JP 1-60392 12/1989 ..... B24C/5/02
JP 5-86274 12/1993 ..... B08B/3/02
JP 8-168729 7/1996 ..... B08B/3/08

* cited by examiner

*Primary Examiner*—Joseph J. Hail, III
*Assistant Examiner*—Anthony Ojini
(74) *Attorney, Agent, or Firm*—Sughrue Mion, PLLC

(57) ABSTRACT

A water pump is connected to a mixer so as to blast high pressure water at a high speed in the mixer. The air and powder are supplied to the blast flow of the high pressure water through an air supply pipe and a powder supply pipe respectively so that a mixture flow composed of the gas, the droplet-like fluid, and powder is formed. The mixture flow is blasted from a nozzle at a high speed so as to be sprayed onto a surface to be treated. Thus, impact actions held by the powder and the droplet-like fluid as cleansing/scraping media are given to the surface to be treated. Thus, a cleansing/scraping operation is achieved. Then, if the fluid, gas or the like supplied to the mixer is heated, the cleansing/scraping operation can be further accelerated.

25 Claims, 9 Drawing Sheets

METHOD FOR CLEANSING/SCRAPING AND APPARATUS THEREFOR

BACKGROUND OF THE INVENTION

1. Field of the Invention

The present invention relates to a cleansing/scraping technique for cleansing surfaces of a desired body, for example, from a large one such as a car, a railway vehicle, an aircraft, a building wall, or the like, to a relatively small one such as tableware, or the like, of stains adhering thereto, or for scraping adhesive matters such as a label, a coating, etc. adhering to a surface of an article. Particularly, the present invention relates to a technique for forming a cleansing/scraping media flow blasted from a nozzle toward a surface to be treated. Such cleansing/scraping media include media for a cleansing operation or a scraping operation, and media for both the cleansing operation and the scraping operation.

The present application is based on Japanese Patent Applications No. Hei. 11-74627, 11-239395 and 11-239396, which are incorporated herein by reference.

2. Description of the Related Art

As background-art cleansing methods, there are generally carried out a method of applying detergent liquid to the surface of a subject to be cleansed, rubbing the surface with a brush or the like and rinsing the surface with water, or a method of spraying high pressure water or steam onto the surface of a subject to be cleansed to thereby cleansing or scraping dirt or adhesive matter adhering to the surface. There is also known a method in which a low pressure gas flow carrying droplet-like or mist-like fluid is sprayed and then cleansing is performed by a blast flow having a high speed and a large sectional area (Japanese Patent Publication No. Hei. 5-86274). Further, there is known a method in which a soluble powder-like substance such as sodium acid carbonate or the like is added to fluid, and the pressured fluid is sprayed, so that cleansing is carried out with a physical cleansing operation based on an impact action of the soluble powder-like substance material (Japanese Patent Publication No. Hei. 8-168729). In addition, there is known a dry blast apparatus for high speed blasting of a low pressure air flow carrying a polishing/cleansing material (Japanese Patent Publication No. Hei. 1-60392).

In the background art in which a high pressure fluid or low pressure gas flow carrying droplet-like or mist-like fluid is sprayed to carry out cleansing, however, a blast flow of the high pressure fluid or the droplet-like or mist-like fluid is prevented from reaching a surface to be cleansed by a thin film layer formed on the surface to be treated, so that the cleansing operation is lowered. Moreover, in the case of using the low pressure gas flow, it is necessary, as a prerequisite, to supply a large quantity of gas. Therefore, a pressure gas generator having a low- pressure and large-quantity discharge performance such as a Roots blower or the like was used as a background-art pressure gas generator. That is, there was a problem that the degree of freedom to select the kind of the pressure gas generator was small, the size of an apparatus tended to be large, and further the diameter of a gas supply pipe from the pressure gas generator to a mixer became large.

Further, in the cleansing method where powder of sodium hydrogen carbonate or the like is added to fluid, and the fluid is sprayed for cleansing, gas is not added to the cleansing/scraping media flow aggressively. Therefore, it was difficult technologically to form a blast flow which was uniform, stable and large in its sectional area.

Still further, since the dry blast means easily damaged a surface to be treated, the dry blast means was difficult to be applied to the case where cleansing was performed merely to remove stains adhering to the surface.

SUMMARY OF THE INVENTION

The present invention has been developed in view of the foregoing background-art technological circumstances.

It is an object of the present invention to improve such a cleansing operation in the background art more greatly.

It is another object of the present invention to develop a cleansing/scraping technique effective in the operation of scraping adhesive matter adhering to a surface of a subject as well as in the operation of cleansing the surface. In that case, it is another object of the present invention to provide a mixture flow formation technique in which a more excellent mixture flow as the base of the cleansing/scraping operation is formed so that a superior cleansing/scraping operation can be ensured.

It is still another object of the present invention to provide an improved cleansing/scraping technique in which various treatment modes, for example, a mode chiefly having a cleansing operation, a mode chiefly having a scraping operation, or a mode formed of a combination of the both, can be selected in accordance with necessity.

It is still another object of the present invention to provide a technique for forming a cleansing/scraping media flow, in which a desirable kind of apparatus such as a turbo blower, or reciprocating or rotating compressor or the like other than a Roots blower can be selected as the above-mentioned pressure gas generator effectively in miniaturizing the external shape as an apparatus or a gas supply pipe reaching a mixer, and a cleansing/scraping media flow which is uniform, stable and large in its blast flow sectional area can be obtained easily.

The present invention commonly employs, as a basic configuration, such a technical means comprising the steps of: connecting a pressure fluid supply means to a mixer so as to blast fluid at a high speed in the mixer; supplying gas and powder to a flow of the fluid to thereby form a mixture flow composed of the gas, the fluid like droplets and the powder; and blasting the mixture flow from a nozzle at a high speed to thereby spray the mixture flow onto a surface to be treated, so that impact actions held by the powder and the droplet-like fluid as cleansing/scraping media are given to the surface to be treated so as to carry out a cleansing/scraping operation. As described above, the present invention has a configuration in which a pressure fluid supply means is connected to a mixer so as to blast fluid at a high speed in the mixer, and gas and powder are supplied to a flow of the fluid. Accordingly, large kinetic energy of the high speed fluid flow is used for catching the gas or powder in the fluid flow so that a superior mixture flow composed of the droplet-like fluid, powder and gas can be formed. Then, the mixture flow is blasted from a nozzle at a high speed, and the powder contained in the mixture flow breaks a thin film layer of the fluid formed on a surface to be treated, reaches the surface to be treated, and gives an impact action to the surface directly. As a result, the impact action of the powder simultaneously cooperates with the impact action of the droplet-like fluid blasted at a high speed so that the cleansing/scraping operation is improved.

The internal space of the mixer may be divided into an upstream space and a downstream space by a partition wall having a small hole, so that fluid is blasted at a high speed into the upstream space on the upstream side of the partition wall, gas is supplied to the upstream space to thereby form a droplet-like fluid flow, and powder is supplied to the downstream space on the downstream side of the partition wall to thereby form a mixture flow of the gas, the droplet-like fluid and the powder, the mixture flow being blasted at a high speed from a nozzle.

In that case, when gas is supplied to the upstream space on the upstream side of the partition wall, a large quantity of gas may be supplied through a pressure gas supply means. Likewise, when powder is supplied to the downstream space on the downstream side of the partition wall, a large quantity of gas together with the powder may be supplied through a pressure gas supply means. Then, the large quantity of gas functions as carrier gas, which is extremely effective in forming a large-diameter and high-speed blast flow when the mixture flow composed of the droplet-like fluid and the powder as cleansing/scraping media is blasted from the nozzle. Then, if the fluid and/or gas used in the present invention are heated in advance, the cleansing/scraping operation can be further accelerated. Steam may be used as the heated gas in that case.

In addition, treatment modes can be selected by adjusting the supply conditions of the pressure fluid, the gas or the powder. That is, various treatment modes from a treatment mode for a cleansing operation to a treatment mode for a scraping operation can be selected by adjusting the supply quantities in the fluid supply passage, the gas supply passage and the powder supply passage or selecting specific kinds of supplies, for example, by selecting the particle size of the powder. In this specification, "cleansing/scraping" means "cleansing and/or scraping". Further, detergent and/or wax may be supplied to the mixer.

As modes for carrying out the present invention, a wide variety of treatment modes from a treatment mode used exclusively for cleansing to a treatment mode used exclusively for scraping can be selected by adjusting the supply quantities and kinds of fluid, powder and/or gas, as described above. That is, if the supply quantity of fluid or gas such as air is increased while the supply quantity of powder is decreased or if powder having a small scraping effect is adopted, the treatment mode can be set to a mode where the cleansing operation accounts for a large rate. On the contrary, if the supply quantity of fluid or gas is decreased while the supply quantity of powder is increased or if powder having a large scraping effect is adopted, the treatment mode can be set to a mode where the scraping operation accounts for a large rate.

Appropriate fluid such as water, water with an additive of surfactant, or the like, may be used as the above-mentioned fluid. Then, the size of droplets of the fluid can be selected from a fine mist-like size to a large size in accordance with the treatment mode. As the above-mentioned powder, soluble substances which are dissolved in the above-mentioned fluid after the cleansing/scraping such as sodium acid carbonate, dry ice, granular ice, salt, or the like, other than general polishing/cleansing material such as alumina, may be used so as to be dissolved in the above-mentioned fluid after the cleansing/scraping. Then, as for the form of supplying this powder to the mixer, the powder may be supplied in the form of a media stock solution composed of fluid mixed with the powder though it may be supplied directly as it is. On the other hand, as for the form of supplying the above-mentioned fluid or gas to the mixer, the fluid or the gas may be supplied at a room temperature or supplied at a moderately heated state. In that case, steam may be used as the heated gas supplied to the mixer. Then, a suitable heating source such as electrically heating means, combustion heat, steam, etc. may be used as means for heating the fluid or gas. When heated fluid or gas is used, the temperature of the fluid forming a mixture flow is increased so that the cleansing/scraping operation is accelerated. As a result, the effect of the operation is also improved on a large scale. Particularly, in the case where soluble powder is used as the aforementioned powder, the powder becomes easy to be dissolved in hot water or steam due to the temperature rising. Accordingly, by adjusting the solubility through the temperature control by heating, it is also possible to adjust the impact action of the powder. Further, when a large quantity of gas is to be supplied through a pressure gas supply means, an air blower suitable for low pressure and large quantity, such as a Roots blower, a turbo blower, or the like, may be used. Alternatively, a reciprocating or rotating compressor may be used while the pressure is reduced moderately for low pressure and large quantity.

The present invention employs such a technical means comprising the steps of: blasting at least pressure fluid and pressure gas into a mixing space in a mixer at a high speed to thereby form a high speed mixture flow of the pressure fluid and pressure gas; and sucking gas by an ejector effect based on the high speed mixture flow to thereby blast a cleansing/scraping media flow containing the fluid like droplets from a nozzle. In the present invention, carrier gas or forming and carrying a cleansing/scraping media flow includes pressure gas supplied to the mixer and gas sucked by an ejector effect based on the above-mentioned high speed mixture flow. When the pressure gas is blasted into the mixing space in the mixer, the pressure gas expands suddenly, and increases its speed while forming a mixture flow with pressure fluid supplied simultaneously, so as to form a high speed mixture flow containing the droplet-like fluid. In that case, when a small quantity of fluid is supplied to the pressure gas at a high speed, the speed of the mixture flow forming cleansing/scraping media can be prevented from lowering. In addition, another gas sucked by the ejector effect based on the high speed mixture flow is added so that the mixing of the mixture flow is accelerated. It is therefore possible to easily form a cleansing/scraping media flow which is extremely superior in the distribution of droplets. In addition, since gas is sucked by the ejector effect based on the high speed mixture flow of gas and fluid, a large quantity of gas can be sucked in comparison with the case of an ejector effect based on a high speed flow composed of only pressure gas. Thus, gas sucked by the ejector effect is added to the pressure gas as carrier gas for carrying the cleansing/scraping media. Therefore, pressure gas is not limited to background-art low pressure gas, but various modes an be carried out by adjusting the pressure or supply quantity of the pressure gas or the quantity of gas to be sucked.

Further, the mixing space in the mixer may be divided into an upstream space and a downstream space by a partition wall having an aperture portion, and at least pressure fluid and pressure gas are blasted at a high speed into the upstream space on the upstream side of the partition wall to thereby suck gas by an ejector effect based on a high speed mixture flow of the pressure fluid and pressure gas, while powder or detergent is supplied to a desirable space, that is, either one of or both of the upstream side and downstream side spaces of the above-mentioned partition to thereby form a cleansing/scraping media flow containing the gas, the droplet-like fluid and the powder. Then, if the above-mentioned pressure fluid and/or pressure gas used in the present invention are used in the state where they are heated in advance, the cleansing/scraping operation can be further accelerated. In that case, steam may be used as the pressure gas. In addition, treatment modes can be selected by changing the supply conditions of at least one of the above-mentioned fluid, gas, powder and detergent. That is, the pressure or supply quantity of the pressure fluid or the pressure gas, the quantity of gas to be sucked, and so on are adjusted through control valves or the like provided in their supply passages respectively. Alternatively, the supply quantity of the powder or detergent is adjusted, or the specific kinds of supplies, for example, the particle size of the powder, or the like, are selected. Thus, various treatment modes can be selected from a treatment mode exclusive for a cleansing operation to a treatment mode exclusive for a scraping operation.

As modes for carrying out the present invention, any form may be taken so long as at least pressure fluid and pressure gas are supplied to a mixer so as to form a high speed mixture flow. That is, a form in which pressure fluid and pressure gas are supplied to thereby form a mixture flow composed of only the fluid and gas may be adopted, or not to say, a form in which powder and so on are added to the mixture flow in accordance with necessity may be adopted as shown in the following embodiment. In addition, if the supply conditions or kinds of the above-mentioned pressure fluid, pressure gas, sucked gas, powder and/or detergent are adjusted, treatment modes can be selected in a wide range from a treatment mode exclusively used for cleansing to a treatment mode exclusively used for scraping. For example, if the supply quantity of fluid or gas such as the air is increased and the supply quantity of powder is decreased or if powder having a small scraping effect is adopted, the treatment mode can be set to a mode where the cleansing operation accounts for a large rate. On the contrary, if the supply quantity of fluid or gas is decreased while the supply quantity of powder is increased or if powder having a large scraping effect is adopted, the treatment mode can be set to a mode where the scraping operation accounts for a large rate. Then, as for the form of supplying powder to the mixer, the powder may be supplied in the form of a media stock solution composed of fluid mixed with the powder though it may be supplied directly as it is. On the other hand, when the above-mentioned pressure fluid, pressure gas, sucked gas, powder or detergent may be supplied to the mixer after they are heated in advance, a cleansing scraping operation can be improved. In that case, steam may be used as the pressure gas supplied to the mixer. Then, a suitable heating source such as electrically heating means, combustion heat, steam, etc. may be used as means for heating the fluid or gas. When heated fluid or gas is used in such a manner, the temperature of the fluid or the like forming a mixture flow is increased so that the cleansing/scraping operation is accelerated. As a result, the effect of the operation is improved on a large scale.

Features and advantages of the invention will be evident from the following detailed description of the preferred embodiments described in conjunction with the attached drawings.

DETAILED DESCRIPTION OF THE PREFERRED EMBODIMENTS

Figure 1:
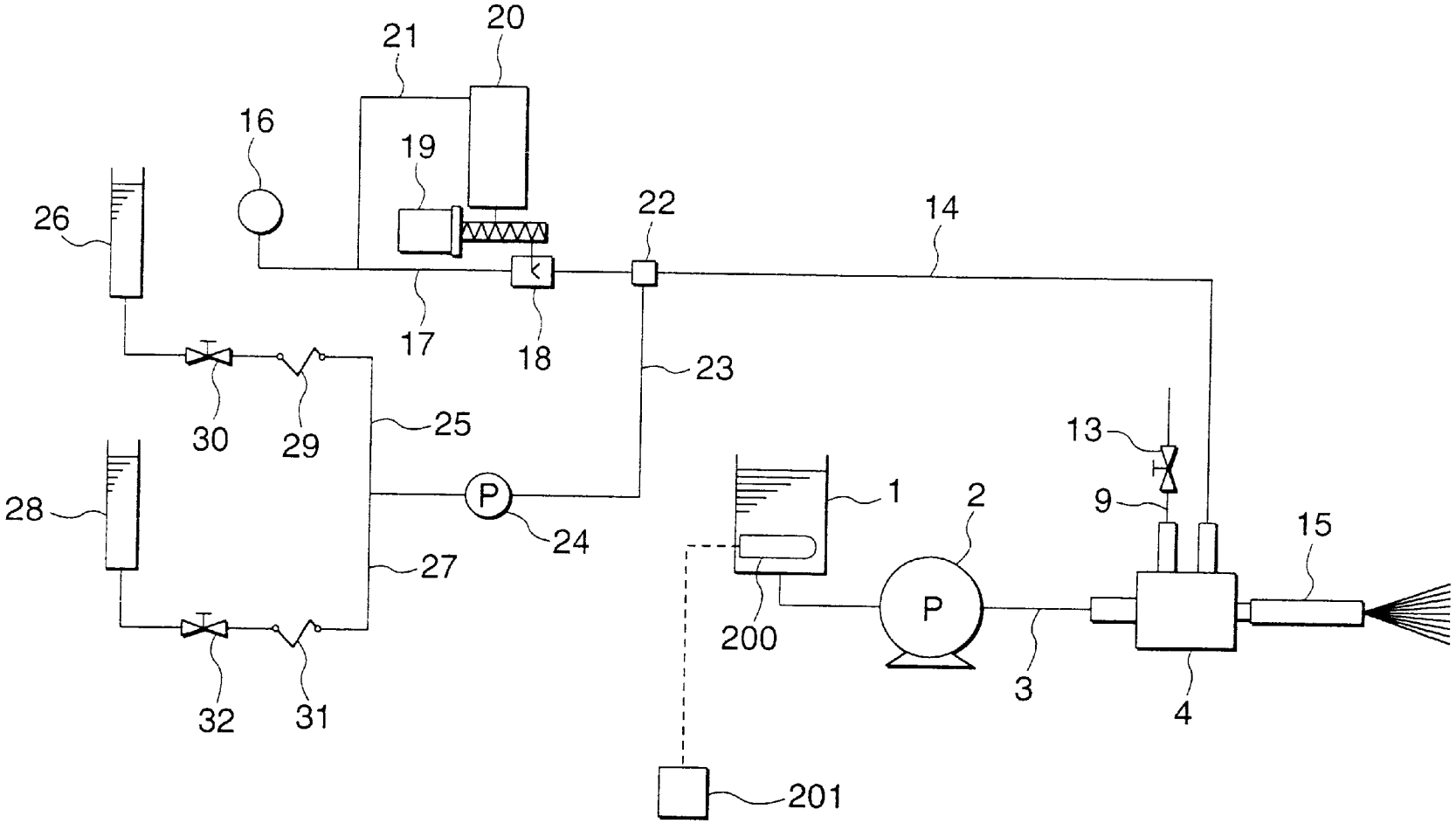
FIG. 1 is a schematic configuration view showing a main part of a first embodiment according to the present invention.
Figure 2:
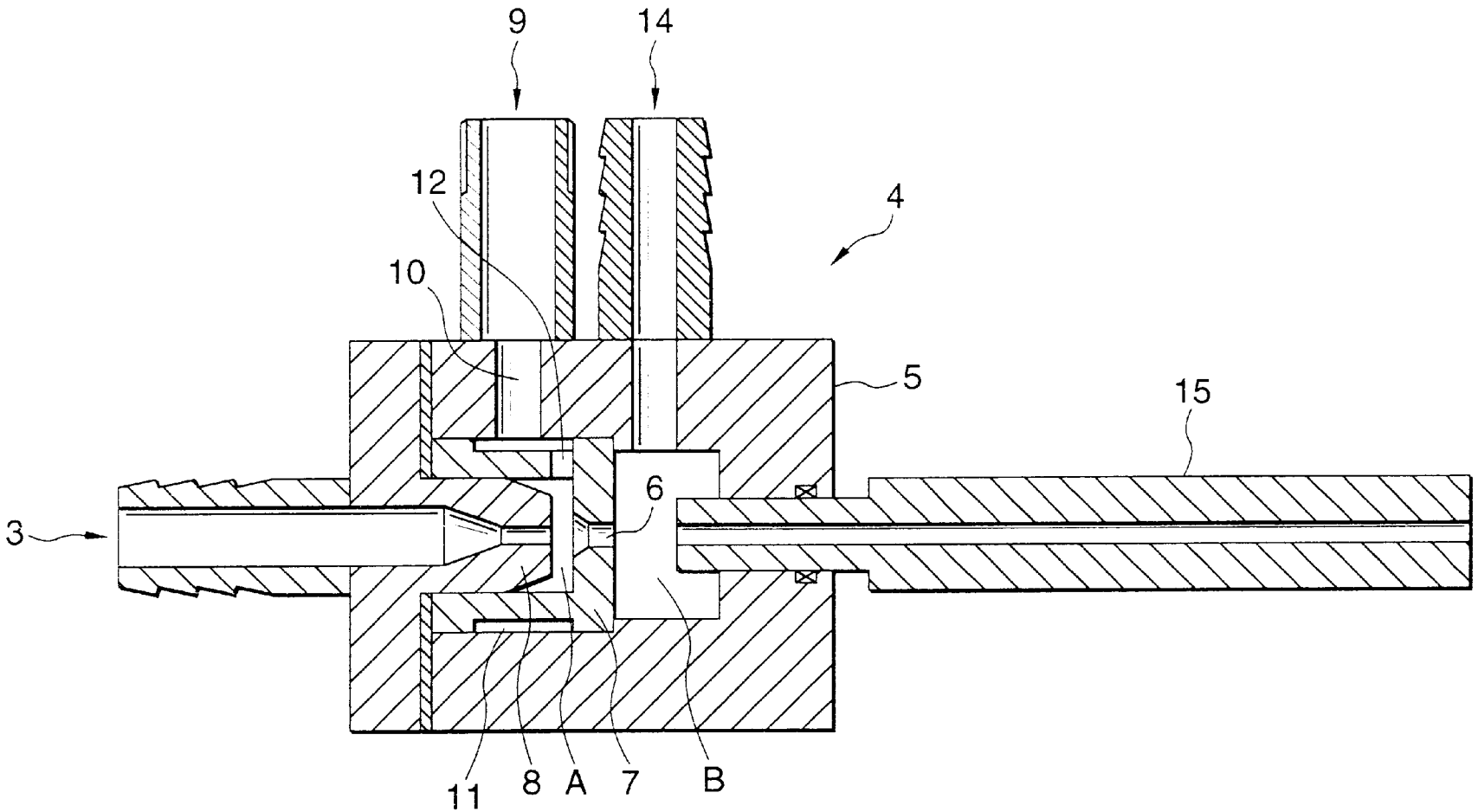
FIG. 2 is an enlarged sectional view showing a mixer according to the present invention.

Embodiments of the present invention will be described below with reference to the drawings. FIG. 1 is a schematic configuration view schematically showing a main part of a first embodiment of the present invention. FIG. 2 is a partially enlarged view of the portion of a mixer of FIG. 1. As illustrated, in this embodiment, the above-mentioned pressure fluid supply means is constituted by a water tank 1 and a high pressure water pump 2, from which high pressure water is supplied to a mixer 4 through a high pressure water supply pipe 3. As shown in FIG. 2, the mixer 4 is designed so that the internal space of a mixer body 5 of the mixer 4 is divided into spaces A and B by a partition wall portion of a partition wall member 7 having a small hole 6, and high pressure water from the high pressure water pump 2 is blasted at a high speed into the upstream space A from an internal blast port 8 through the high pressure water supply pipe 3. In addition, an air supply pipe 9 forming the above-mentioned gas supply passage is connected to the space A. By the ejector effect of a high speed water flow from the internal blast port 8, the air is sucked through the air supply pipe 9, a communicating hole 10 formed in the mixer body 5, a channel 11 formed between the mixer body and the partition wall member 7, and a communicating hole 12 formed in the partition wall member 7. In FIG. 1, the reference numeral 13 represents a valve mechanism disposed in the air supply pipe. Then, a suitable heating means 200 such as an electric heater or the like connected to a temperature control device 201 is disposed in the water tank 1 so that high pressure heated water is supplied to the mixer 4. In that case, when the temperature of a mixture flow blasted from a nozzle 15 at a high speed is increased moderately, the cleansing/scraping operation can be accelerated.

A powder supply pipe 14 forming a powder supply passage and a nozzle 15 for blasting the above-mentioned mixture flow composed of gas, droplet-like fluid and powder are connected to the downstream space B divided by the partition wall portion. In this case, not to say, the nozzle 15 can be extended to a forward position if a hose or the like is put between the space B and the nozzle 15. A pressure gas supply means 16 constituted by a blower, a compressor or the like and having a pressure range of from about 0.5 $kgf/cm^2$ to about 8 $kgf/cm^2$ is connected to an upstream end portion of the powder supply pipe 14. An injection portion 18 for powder as a cleansing/scraping medium is disposed in an air channel 17 on the downstream side of the pressure gas supply means 16. A powder supply means is constituted by a delivery mechanism 19, which is, for example, a screw system or the like, and a tank 20 for the powder. The powder supply means is connected to the injection portion 18 so that the supply/suspension of the powder from the injection portion 18 and the supply quantity of the powder can be controlled by controlling the delivery mechanism 19. A plurality of such delivery mechanisms 19 and tanks 20 may be provided for retaining various powders so that the kind of powder used for cleansing/scraping can be changed by switching powders to be supplied or changing their supply ratio. In that case, individual injection portions 18 may be provided correspondingly to the respective delivery mechanisms 19. Further, a communicating pipe 21 may be provided in an upper portion of the tank 20 as shown in FIG. 1 so that the internal pressure of the air channel 17 which may be used as delivery pressure for the powder can be introduced into the tank 20.

In this embodiment, detergent and/or wax can be supplied through an injection portion 22 disposed in the middle of the powder supply pipe 14 on the downstream side of the injection portion 18. That is, a pressurizing means 24 constituted by a pump and so on is disposed in the middle of a supply pipe 23 connected to the injection portion 22. Further, a detergent tank 26 for supplying surfactant is connected through a branch pipe 25 while a wax fluid tank 28 is connected through a branch pipe 27. Incidentally, an electromagnetic on-off valve 29 and a flow control valve 30 are disposed in an intermediate portion of the branch pipe 25 so as to control the supply/suspension of the detergent and the supply quantity thereof. In addition, an electromagnetic on-off valve 31 and a flow control valve 32 are disposed in an intermediate portion of the branch pipe 27 so as to control the supply/suspension of the wax and the supply quantity thereof. Then, bactericide, or the like can be supplied instead of the detergent or wax.

Thus, when the cleansing/scraping apparatus according to this embodiment is used, high pressure water supplied through the high pressure water pump 2 is blasted at a high speed from the internal blast port 8 disposed in the upstream space A of the mixer 4. Then, the high pressure water is blasted into the downstream space B through the small hole 6 while being mixed with the air sucked from the air supply pipe 9 by the ejector effect of the high speed blast flow of the high pressure water. In that process, a droplet-like fluid flow is formed gradually. In addition to the droplet-like fluid flow, powder mixed with a large quantity of the air is supplied to the space B from the pressure gas supply means 16 through the powder supply pipe 14. The droplet-like fluid flow and the large quantity air and powder are blasted at a high speed from the nozzle 15 while being mixed. In that process, a mixture flow composed of the gas, the droplet-like fluid and the powder is formed and sprayed on a surface to be treated, so that expected cleansing/scraping is performed. In that case, various treatment modes can be selected within a wide range of from a treatment mode exclusive for the cleansing operation to a treatment mode exclusive for the scraping operation when the ejection pressure or flow rate of the high pressure water pump 2 or the pressure gas supply means 16 is controlled; when the supply quantity of the delivery mechanism 19 is controlled; or when a plurality of delivery mechanisms 19 and tanks 20 are provided for reserving various powders as mentioned above, so that the kind of powder is changed by switching powder to be supplied or changing the supplying ratio of the powders. Incidentally, as described above, heating means may be provided in the water tank 1, on the downstream side of the pressure gas supply means 16, or in the middle of the air supply pipe 9 so as to moderately increase the temperature of the mixture flow blasted at a high speed from the nozzle 15. As a result, the cleansing/scraping operation can be accelerated.

If an objected to be treated is graffiti on the wall, specification of the cleansing operation is generally set as follows:

Powder: sodium bicarbonate ($NaHCO_3$) (particle size of 240 micron and amount of 300 to 1000 g/min.)

Pressure of water: 50 to 140 MPa;

Amount of water: 5 to 13 liter/min.

Pressure of air: 2 to 4 MPa

Amount of air: 0.5 to 1 $m^3$/min.

If an objected to be treated is plating of the wheel cap, specification of the scraping operation is generally set as follows:

Powder: garnet ($A_3B_2(SiO_4)_3$) (amount of 600 to 1000 g/min.)

Pressure of water: 100 to 140 MPa

Amount of water: 9 to 13 liter/min.

Pressure of air: 2 to 3 MPa

Amount of air: 1 to 1.4 $m^3$/min.

Further, detergent may be supplied from the detergent tank 26 to the injection portion 22 through the pressurizing means 24 so as to be supplied to the mixer 4 while being mixed with a large quantity of the air from the pressure gas supply means 16. As a result, the cleansing operation can be further improved by the surface active effect of the detergent. Then, the detergent may be added to the water tank 1. Moreover, the following manner may be adopted. That is, the supply of the powder is stopped by the delivery mechanism 19 and the electromagnetic on-off valve 29 is closed to stop the supply of the detergent. Then, the high pressure water pump 2 is suspended and the valve means 13 is closed. In this state, the electromagnetic on-off valve 31 is opened so that wax is supplied from the wax fluid tank 28 to the mixer 4 while being mixed with a large quantity of the air from the pressure gas supply means 16. As a result, the wax can be applied onto a surface to be treated through the nozzle 15 while being carried on the large quantity air flow, so that the workability in waxing can be improved. Further, if the electromagnetic on-off valve 31 is closed so that only a large quantity of the air is supplied from the pressure gas supply means 16, the air flow blasted at a high speed from the nozzle 15 can be sprayed onto the surface to be treated so that moisture, etc. adhering to the surface to be treated can be blown off. Thus, the surface to be treated can be dried easily.

Figure 3:
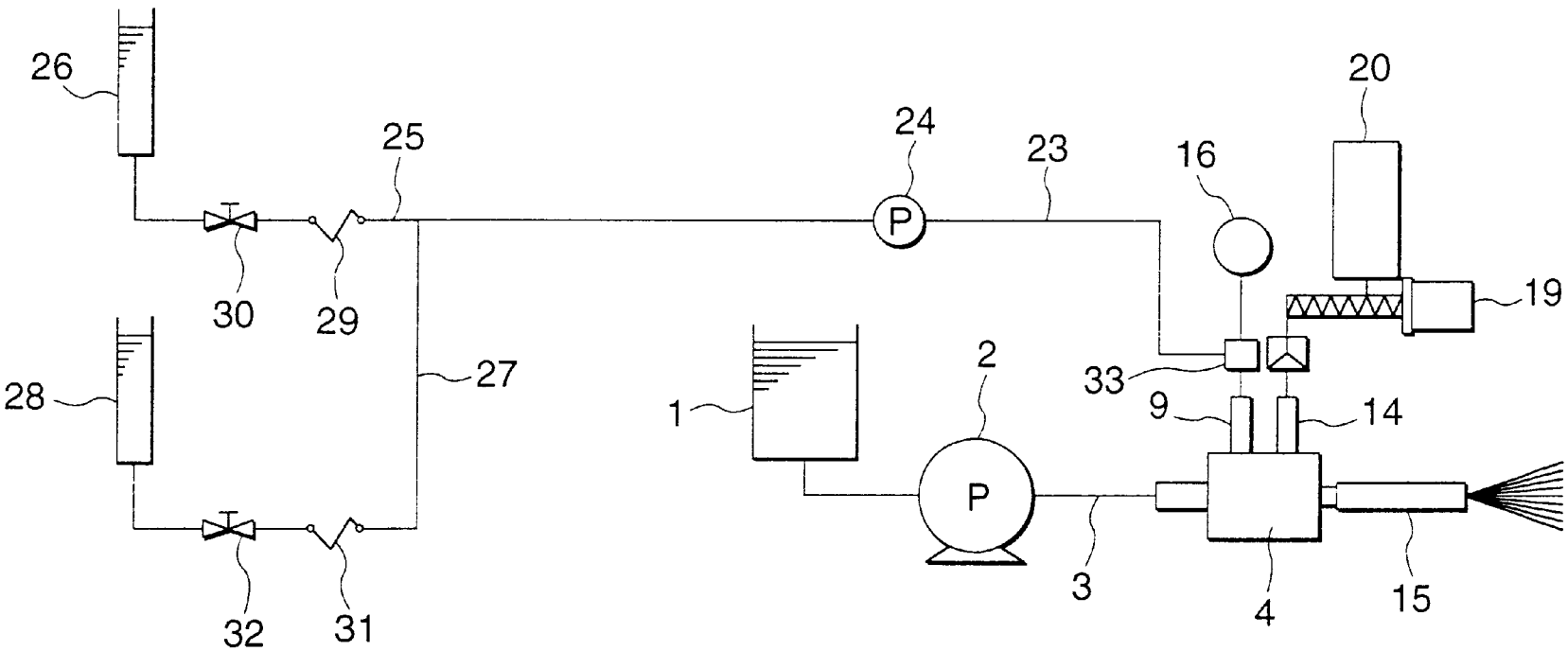
FIG. 3 is a schematic configuration view showing a main part of a second embodiment according to the present invention.

FIG. 3 is a schematic configuration view showing a main part of a second embodiment of the present invention. In this embodiment, constituent parts the same as those in the aforementioned embodiment are referenced correspondingly. This embodiment has features about how to connect the upstream sides of an air supply pipe 9 and a powder supply pipe 14 to a mixer 4. That is, in this embodiment, a pressure gas supply means 16 constituted by a blower, a compressor, or the like is connected to an upstream end portion of an air supply pipe 9 so as to send a large quantity of the air into the mixer through the air supply pipe 9. In addition, a supply pipe 23 is connected to the air supply pipe 9 through an injection portion 33 disposed in an intermediate portion on the downstream side of the pressure gas supply pipe 33. A pressurizing means 24 constituted by a pump or the like is disposed in an intermediate portion of the supply pipe 23. Further, a detergent tank 26 for supplying surfactant is connected through a branch pipe 25 while a wax fluid tank 28 is connected through a branch pipe 27. In addition, an electromagnetic on-off valve 29 and a flow control valve 30 are disposed in an intermediate portion of the branch pipe 25 while an electromagnetic on-off valve 31 and a flow control valve 32 are disposed in an intermediate portion of the branch pipe 27. On the other hand, a powder supply means constituted by a delivery mechanism 19 and a tank 20 for powder is connected to the upstream side of the powder supply pipe 14. The powder is supplied to the mixer 4 not by a large quantity of the air from the pressure gas supply means 16 as in the above embodiment but by the dead weight of the powder. Also in this case, an air supply means for carrying the powder may be added in accordance with necessity. Incidentally, the cleansing/scraping operation can be accelerated if a suitable heating means such as an electric heater or the like is disposed in a water tank 1 or the like so as to moderately increase the temperature of a mixture flow blasted from a nozzle 15 at a high speed in the same manner as in the above embodiment. In addition, the powder may be supplied to the mixer 4 through the powder supply pipe 14 in the form of a media stock solution composed of fluid mixed with the powder.

Thus, in this embodiment, high pressure water from a high pressure water pump 2 is blasted at a high speed from an internal blast port 8 through a high pressure water supply pipe 3 into an upstream space A divided by a partition wall portion while a large quantity of the air is forcedly supplied from the pressure gas supply means 16 to the space A through the air supply pipe 9. Accordingly, making the droplets into water flow is accelerated more greatly. Then, the other manners such as the way of use of a cleansing/scraping apparatus, or the like in this embodiment are basically not different from those in the aforementioned embodiment and have similar functions.

Figure 4:
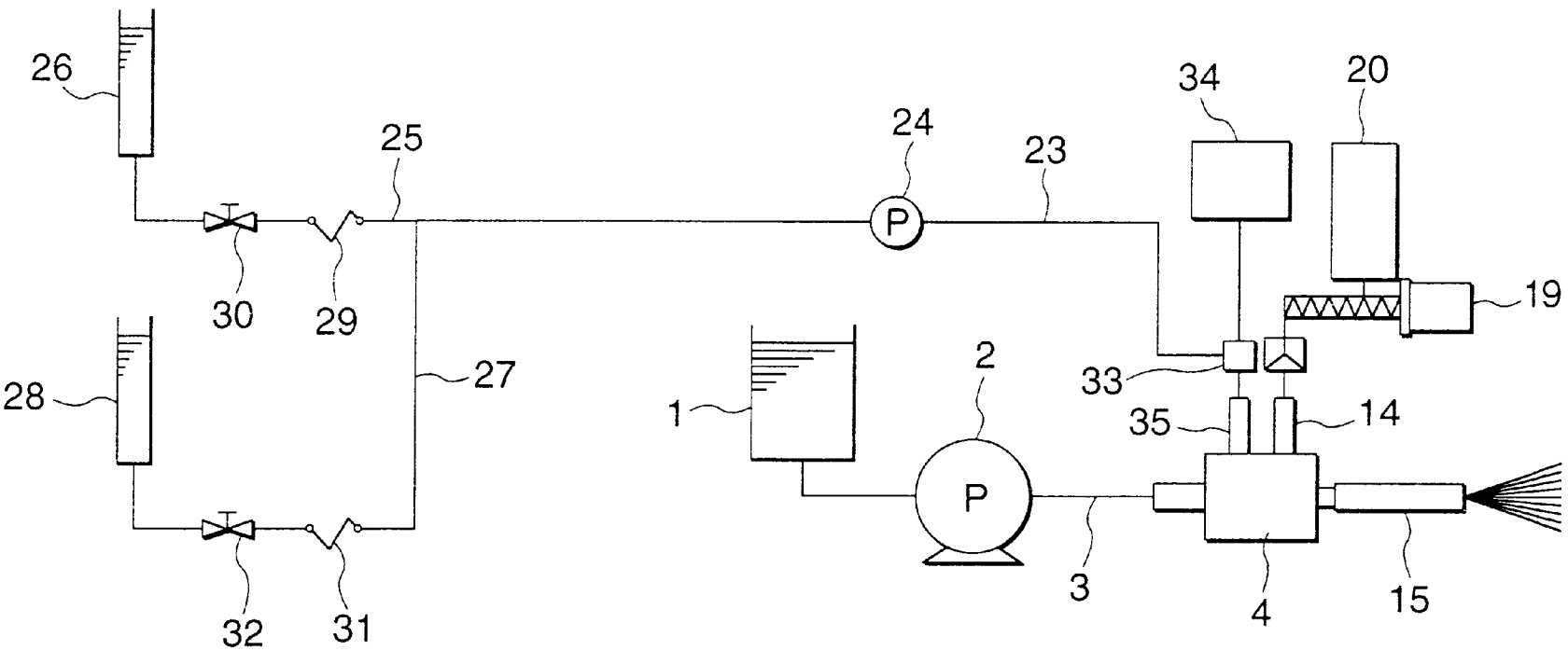
FIG. 4 is a schematic configuration view showing a main part of a third embodiment according to the present invention.

FIG. 4 is a schematic configuration view showing a main part of a third embodiment of the present invention. This embodiment shows a modification of FIG. 3. The other configurations in this embodiment are basically not different from those in the aforementioned embodiments, except that a steam supply source 34 is adopted as the above-mentioned pressure gas supply means 16 so as to supply pressure gas to the mixer 4 through a steam supply pipe 35 in the form of steam. Thus, in this embodiment, high temperature steam is supplied to the mixer 4 as pressure gas so that the temperature of a mixture flow blasted from the nozzle 15 is increased. As a result, the cleansing/scraping operation of the mixture flow is accelerated, and the effect of the operation is also improved on a large scale. Incidentally, a suitable heating means such as an electric heater or the like may be further provided in the water tank 1 or the like in the same manner as in the above embodiments. In addition, powder may be supplied to the mixer 4 through the above-mentioned powder supply pipe 14 in the form of a media stock solution composed of fluid mixed with the powder. Then, if soluble powder is used as the aforementioned powder, the powder becomes easy to be dissolved due to temperature rising by the aforementioned steam or the like. Therefore, the impact action of the powder can be controlled through the temperature controlled by heating.

Figure 5:
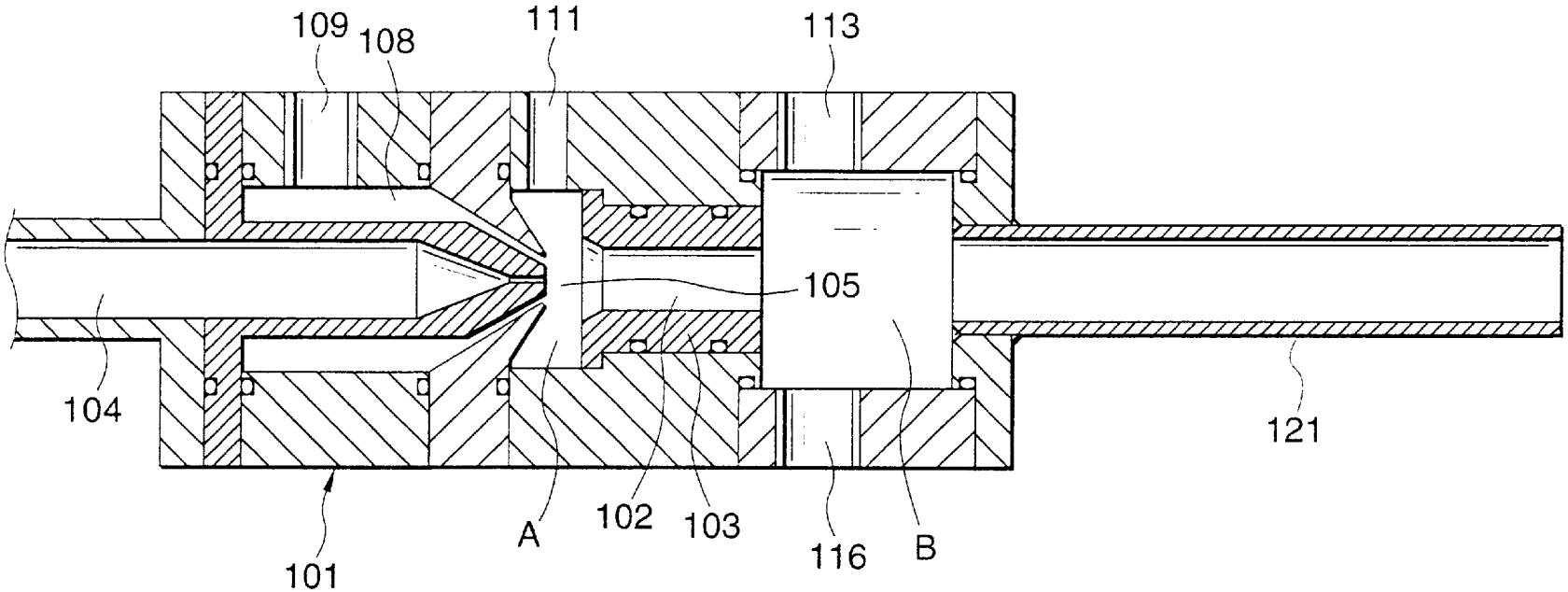
FIG. 5 is an enlarged sectional view showing another mixer according to the present invention.
Figure 6:
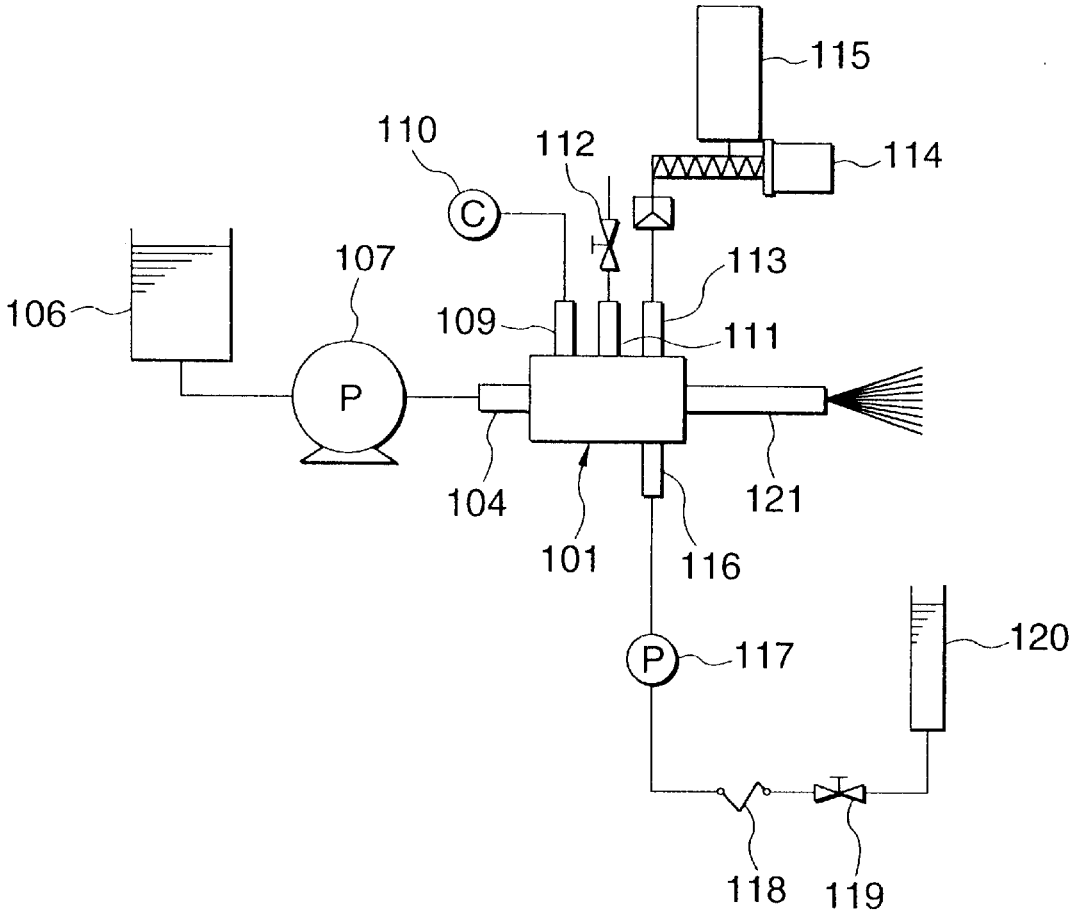
FIG. 6 is a schematic configuration view showing a main part of a fourth embodiment according to the present invention.

FIG. 5 is a longitudinally sectional view showing another type of a mixer according to the present invention. FIG. 6 is a configuration circuit view showing a main part of a fourth embodiment using the mixer. As shown in FIG. 5, a mixer 101 in this embodiment is designed so that its mixing space is divided into spaces A and B by a partition wall member 103 having an aperture portion 102. Pressure water as the pressure fluid is blasted into the upstream space A through a primary inlet channel 104 and a blast portion 105 for driving fluid. That is, as shown in FIG. 6, water from a water tank 106 is pressured by a pump 107 so as to be blasted from the blast portion 105 into the space A as the pressure fluid. On the other hand, a pressure gas generator 110 such as a compressor or the like is connected through a connection portion 109 to a secondary inlet channel 108 formed around the primary inlet channel 104 as shown in FIG. 5. The pressure gas generator 110 is designed to blast the pressure air as pressure gas into the space A through the blast portion 105 simultaneously with blasting of the pressure water so as to enclose the pressure water. Further, the space A is made to communicate with the atmosphere through a gas inlet channel 111 and a valve 112 shown in FIG. 6. Then, a heating means may be disposed in the water tank 106, on the downstream side of the pressure gas generator 110 or in the course of the gas inlet channel 111 so as to moderately increase the temperature of a mixture flow blasted from a nozzle 121 at a high speed. As a result, the cleansing/scraping operation can be further accelerated.

A powder supply means is constituted by a delivery mechanism 114, which is, for example, of a screw system, and a tank 115 for powder, as shown in FIG. 6. The powder supply means is connected to the space B through a connection portion 113 so as to supply the powder to the space B. The powder may be supplied to the mixer 101 as it is or in the form of a media stock solution composed of fluid mixed with the powder. Further, a detergent tank 120 is connected to a connection portion 116 of the space B through a pump 117, an electromagnetic valve 118 and a flow control valve 119 so that detergent can be supplied to the space B. Then, the reference numeral 121 in FIGS. 5 and 6 represents a nozzle which is connected directly to the space B in this embodiment. The nozzle 121 may be, however, connected to a pointed end of a flexible hose or the like connected to the space B, or another nozzle may be connected to the nozzle 121 through a flexible hose or the like connected to an pointed end of the nozzle 121.

Thus, pressure water as the pressure fluid is blasted into the space A through the primary inlet channel 104 and the blast portion 105 while pressure air as the pressure gas is blasted through the secondary inlet channel 108 so as to enclose the pressure water. Then, the both are mixed to form a high speed mixture flow while flowing into the space B through the aperture portion 102. The mixture flow is further blasted through the nozzle 121 as a cleansing/scraping media flow so as to serve for the cleansing and/or scraping. In that case, the pressure air blasted into the space A is mixed with the pressure water while expanding suddenly. Thus, a mixture flow of the pressure air and the pressure water is accelerated and made into a high speed mixture flow. As a result, the atmosphere is sucked into the space A through the gas inlet channel 111 by an ejector effect based on the high speed mixture flow. The sucked atmosphere is added to the pressure air from the secondary inlet channel 108 as carrier gas for carrying cleansing/scraping media. Thus, cleansing/scraping media flow containing droplet-like fluid can be formed more effectively. Then, the quantity of atmosphere to be sucked can be controlled through the valve 112. On the other hand, in the space B, the high speed mixture flow flowing therein through the aperture portion 102 involves the powder and detergent supplied through the connection portions 113 and 116 as mentioned above when the high speed mixture flow passes through the space B. As a result, a cleansing/scraping media flow composed of a large quantity of air flow containing those powder, detergent and droplet-like fluid is formed, and blasted from the nozzle 121 toward a surface to be treated. Although the mixing space is divided into the spaces A and B in this embodiment, a form in which the mixing space is not divided may be adopted. Further, a heating portion is provided in a supply passage of the pressure water, pressure air, detergent or the like in order to supply them to the mixer 101 in the heated state. As a result, the cleansing and/or scraping operation can be further improved. In addition, when a soluble substance is used as the powder and the pressure water or the like is heated, the powder becomes easy to be dissolved due to the temperature rising. Accordingly, by adjusting the solubility through the temperature control by heating, it is also possible to adjust the impact action of the powder.

Figure 7:
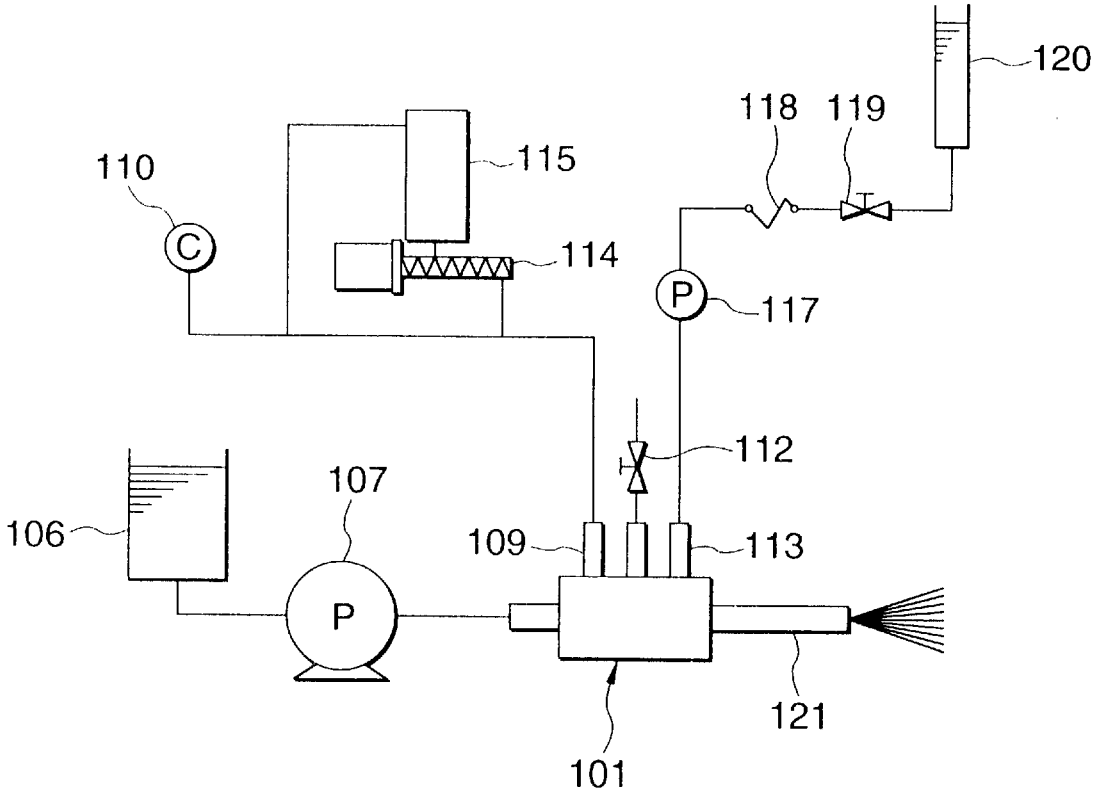
FIG. 7 is a schematic configuration view showing a main part of a fifth embodiment according to the present invention.

FIG. 7 is a configuration circuit view showing a main part of a fifth embodiment of the present invention. This embodiment is different from the fourth embodiment in the point that the powder supply means constituted by the delivery mechanism 114 and the powder tank 115 is set between the connection portion 109 connected to the secondary inlet channel 108 of the mixer 101 and the pressure gas generator 110. That is, the fourth embodiment is modified in this fifth embodiment so that powder is supplied together with the pressure air supplied through the secondary inlet channel 108. In this embodiment, a supply line for detergent is changed to be connected with the connection portion 113 and the connection portion 116 is omitted. However, not to say, the connection portion 113 may be omitted without changing the connection of the detergent supply line. Further, the pressure water, pressure air, detergent or the like may be heated in advance, or soluble powder may be used as the above-mentioned powder in the same manner as in the aforementioned embodiments. In that case, by adjusting the solubility through the temperature control by heating the pressure water or the like, it is also possible to adjust the impact action of the powder.

Figure 8:
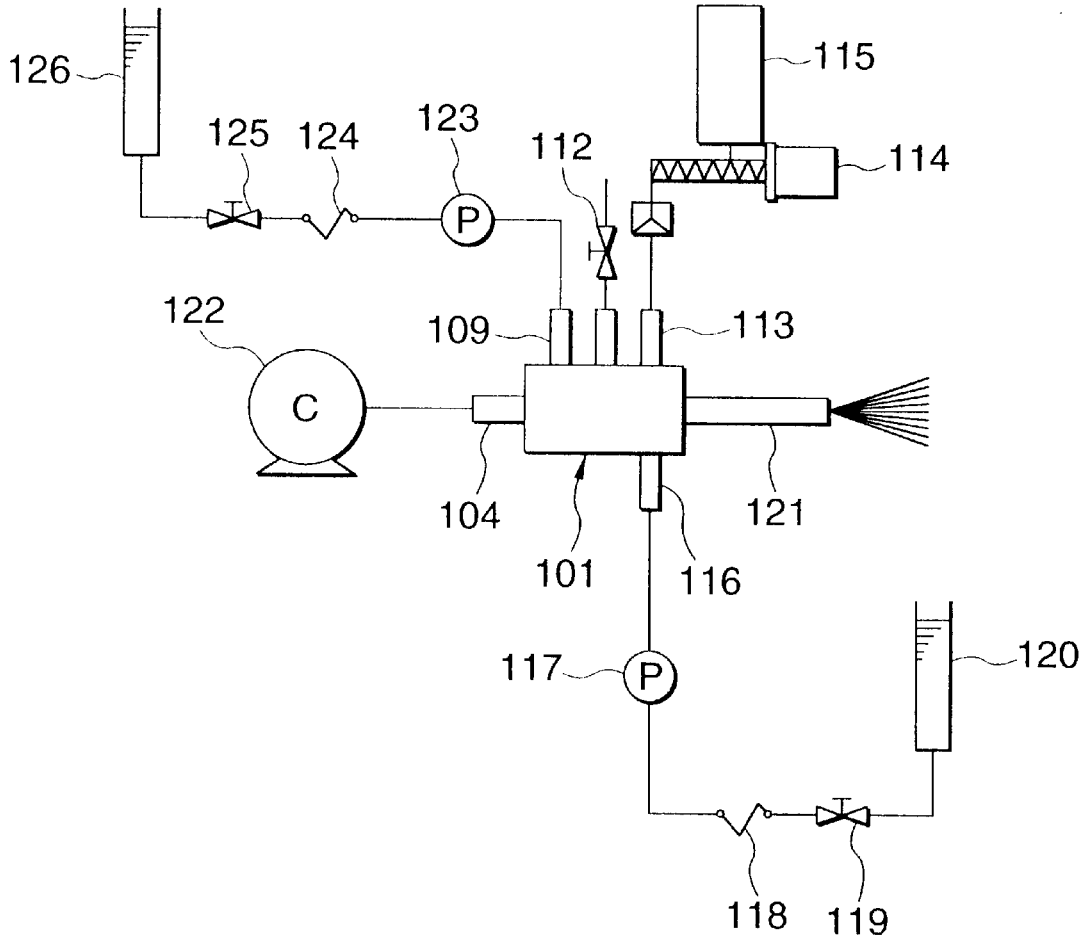
FIG. 8 is a schematic configuration view showing a main part of a sixth embodiment according to the present invention.

FIG. 8 is a configuration circuit view showing a main part of a sixth embodiment of the present invention. This embodiment is different from the fourth embodiment in the point that a pressure gas generator 122 such as a compressor or the like is connected to the primary inlet channel 104 of the mixer 1 while a water tank 126 is connected to the connection portion 109 of the secondary inlet channel 108 through a pump 123, an electromagnetic valve 124 and a flow control valve 125. That is, the contents supplied to the primary and secondary inlet channels 104 and 108 are reversed so that pressure air is blasted from the blast portion 105 via the primary inlet channel 104 while pressure water is blasted from the blast portion 105 via the secondary inlet channel 108 so as to enclose the pressure air. The powder may be supplied to the mixer 101 in the form of a media stock solution composed of fluid mixed with the powder. Further, a heating means may be disposed in the water tank 126 so as to heat the pressure water in advance, or the pressure air or detergent may be heated in advance. Further, a soluble substance may be used as the powder. In that case, by adjusting the solubility through the temperature control by heating the pressure water or the like, it is also possible to adjust the impact action of the powder.

Figure 9:
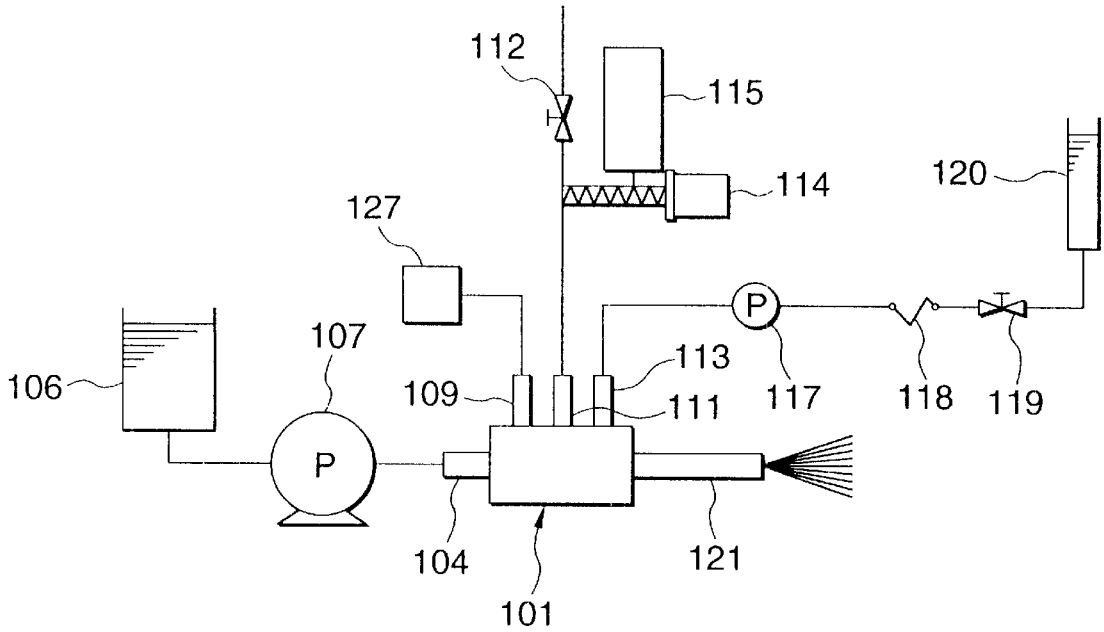
FIG. 9 is a schematic configuration view showing a main part of a seventh embodiment according to the present invention.

FIG. 9 is a configuration circuit view showing a main part of a seventh embodiment of the present invention. This embodiment is a modification of the fifth embodiment shown in FIG. 7. In this embodiment, constituent parts the same as those in FIG. 7 are referenced correspondingly. This seventh embodiment is different from the fifth embodiment in the point that the pressure gas generator 110 is replaced by a steam supply source 127 so that high temperature steam is supplied from the steam supply source 127 to the mixer 101 through a connection portion 109, while a powder supply means constituted by a delivery mechanism 114 and a powder tank 115 is connected between a valve 112 communicating with the atmosphere and a gas inlet channel 111. The other configurations in this seventh embodiment are basically not different from those in the fifth embodiment. That is, this seventh embodiment is characterized in that high temperature steam is used as the pressure gas while the powder is sucked into the mixer 101 together with a large quantity of the air sucked from the atmosphere by the above-mentioned ejector effect. In this case, the powder may be supplied to the mixer 101 as it is or in the form of a media stock solution composed of fluid mixed with the powder. Thus, in this embodiment, the high temperature steam as the pressure gas is supplied to the mixer 101 so as to increase the temperature of a mixture flow blasted from a nozzle 121. As a result, the cleansing/scraping operation of the mixture flow is accelerated, and the effect of the operation is also improved on a large scale. Then, a suitable heating means such as an electric heater or the like maybe further disposed in a water tank 120 or the like. In addition, when soluble powder is used as the above-mentioned powder, the powder becomes easy to be dissolved due to temperature rising by the steam or the like. Accordingly, the impact action of the powder can be controlled through the temperature control by heating the steam or the like. Incidentally, if the powder is not supplied in each aforementioned embodiment, a mixture flow composed of fluid and gas can be obtained.

According to the present invention, it is possible to obtain the following effects:

(1) Fluid is blasted at a high speed in a mixer and gas is mixed with the blast flow of the fluid so that the fluid is made into droplets more precisely. Then, a large quantity of gas is supplied to the mixer through a pressure gas supply means. Accordingly, a mixture flow composed of the gas, the droplet-like fluid and powder which is mixed very well can be blasted at a high speed from a nozzle as cleansing/scraping media.

(2) The powder blasted at a high speed breaks a thin film layer of the fluid formed on a surface to be treated, reaches the surface, and gives an impact action to the surface directly. Accordingly, this impact action of the powder cooperates with the simultaneous impact action of the droplet fluid blasted at a high speed so that an extremely superior cleansing/scraping operation can be obtained.

(3) Treatment modes can be selected by changing the supply conditions of the high pressure fluid, gas or powder supplied to the mixer. That is, if the supply pressure or supply quantity of the fluid, gas or powder, the kinds of the powder and/or fluid, and so on are selected, various treatment modes can be selected from a treatment mode exclusive for the cleansing operation to a treatment mode exclusive for the scraping operation.

(4) If detergent or wax is supplied, the cleansing operation can be enhanced or the workability of waxing can be improved.

(5) If the fluid, gas, or the like supplied to the mixer is heated, the temperature of the mixture flow forming cleansing/scraping media is increased. As a result, the cleansing/scraping operation of the media is accelerated, and hence the effect of the operation is also improved on a large scale. Further, if soluble powder is adopted as the above-mentioned powder, the powder is easy to be dissolved due to temperature rising of the fluid or the like. Accordingly, the impact action of the powder can be controlled by adjusting the solubility of the powder through the temperature control by heating the fluid or the like.

(6) Pressure gas supplied to a mixing space in a mixer is mixed with pressure fluid while expanding suddenly, and a mixture flow of the pressure gas and the pressure fluid is accelerated to form a high speed mixture flow having a high speed off low. Gas sucked by an ejector effect based on the high speed mixture flow is added as carrier gas for carrying cleansing/scraping media. Accordingly, it is possible to more effectively form a superior cleansing/scraping media flow which is superior in the mixture state. Particularly, the present invention is extremely effective when a large quantity of gas is required for forming droplet-like fluid.

(7) Since the carrier gas for carrying cleansing/scraping media is formed of the pressure gas and the gas sucked by the ejector effect, a pressure gas generator is not limited to a background-art one which has a low-pressure and large-quantity discharge performance, but a suitable kind of pressure gas generator such as a turbo blower, or reciprocating or rotating compressor or the like other than a Roots blower can be selected. When a high pressure gas generator is adopted, the size of an apparatus or a gas supply pipe reaching the mixer can be reduced effectively. In addition, various carrying-out modes can be selected by controlling the pressure and supply quantity of the pressure gas or the quantity of gas to be sucked.

(8) The mixing space in the mixer is divided into an upstream space and a downstream space by a partition wall having an aperture portion. At least pressure fluid and pressure gas are blasted at a high speed into the upstream space on the upstream side of the partition wall while powder or detergent is supplied to the downstream space on the downstream side of the partition wall. As a result, it is possible to form a superior cleansing/scraping media flow to which the powder or detergent is added.

(9) The treatment mode can be selected by changing the supply conditions of at least one of the fluid, gas, powder and detergent.

(10) When the pressure fluid or pressure gas supplied to the mixer is heated, the temperature of the mixture flow forming cleansing/scraping media is increased. Accordingly, the cleansing/scraping operation of the cleansing/scraping media is accelerated, and hence the effect of the cleansing/scraping operation is also improved on a large scale. Further, when soluble powder is adopted as the above-mentioned powder, the powder becomes easy to be dissolved due to the temperature rising of the mixture flow. As a result, the impact action of the powder can be controlled by adjusting the solubility through the temperature control by heating the mixture flow.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A cleansing and/or scraping method comprising steps of:

blasting fluid into a mixer at a high speed;

supplying gas, including at least pressurized gas, and powder to a flow of said fluid to thereby form a mixture flow composed of said gas, fluid like droplets and said powder, wherein said pressurized gas is supplied to a mixing space in the mixer and is mixed with the fluid while said pressurized gas suddenly expands in the mixer; and blasting said mixture flow from a nozzle at a high speed to thereby spray said mixture flow onto a surface to be treated, so that impact actions held by said powder and said droplet-like fluid as cleansing and/or scraping media are given to said surface to be treated so as to carry out a cleansing and/or scraping operation.

2. A cleansing and/or scraping method according to claim 1, further comprising steps of:

dividing an internal space of said mixer into an upstream space and a downstream space by a partition wall having a small hole;

blasting said fluid at the high speed into said upstream space on an upstream side of said partition wall;

supplying said gas to said upstream space to thereby form said droplet-like fluid flow;

supplying said powder to said downstream space on a downstream side of said partition wall to thereby form a mixture flow of said gas, said droplet-like fluid and said powder; and blasting said mixture flow at the high speed from said nozzle.

3. A cleansing and/or scraping method according to claim 2, further comprising a step of providing pressure gas supply means through which said gas is supplied to said upstream space on the upstream side of said partition wall.

4. A cleansing and/or scraping method according to claim 2, further comprising a step of providing pressure gas supply means through which said gas is supplied to said downstream space on the downstream side of said partition wall together with said powder.

5. A cleansing and/or scraping method according to claim 1, further comprising a step of heating at least one of said gas and said fluid before blasting and supplying steps.

6. A cleansing and/or scraping method according to claim 1, wherein treatment modes can be selected by changing at least one of supply conditions of said fluid, said gas and said powder.

7. A cleansing and/or scraping method according to claim 1, further comprising a step of supplying at least one of detergent and wax to said mixer.

8. A cleansing and/or scraping apparatus comprising:

pressure fluid supply means;

a mixer;

a fluid supply passage connecting said pressure fluid supply means with said mixer so as to blast a flow of fluid into said mixer at a high speed;

a gas supply passage connected with said mixer so as to supply pressurized gas to said fluid flow which is blasted in said mixer, such that said pressurized gas is supplied to a mixing space in the mixer and is mixed with the fluid flow while said pressurized gas suddenly expands;

a powder supply passage connected with said mixer so as to supply powder to said fluid flow which is blasted in said mixer to thereby form a mixture flow composed of said gas, fluid like droplets and said powder; and a nozzle for blasting said mixture flow at a high speed so that impact actions held by said powder and said droplet-like fluid as cleansing and/or scraping media are given to a surface to be treated so as to carry out a cleansing and/or scraping operation.

9. A cleansing and/or scraping apparatus according to claim 8, wherein an internal space of said mixer is divided into an upstream space and a downstream space by a partition wall having a small hole, and said gas supply passage is connected to said upstream space on a upstream side of said partition wall so as to supply gas to a fluid flow blasted at the high speed into said upstream space to thereby form a droplet-like fluid flow, and said powder supply passage is connected to said downstream space on a downstream of said partition wall to thereby form a mixture flow composed of said gas, said droplet-like fluid and said powder, said mixture flow being blasted from said nozzle.

10. A cleansing and/or scraping apparatus according to claim 8, further comprising pressure gas supply means being connected to said gas supply passage so as to supply said gas through said pressure gas supply means.

11. A cleansing and/or scraping apparatus according to claim 8, further comprising pressure gas supply means being connected to said powder supply passage so as to supply said gas together with said powder through said pressure gas supply means.

12. A cleansing and/or scraping apparatus according to claim 8, further comprising means for heating at least one of said gas and said fluid before supplying to said mixer.

13. A cleansing and/or scraping apparatus according to claim 8, further comprising at least one of a detergent supply passage and a wax supply passage being connected to said powder supply passage.

14. A cleansing and/or scraping apparatus according to claim 8, wherein at least one of said fluid supply passage, said gas supply passage and said powder supply passage is made controllable so that a treatment mode can be changed through a control of said passage.

15. The cleansing and/or scraping apparatus according to claim 8, further comprising a blast port provided in said mixing space in said mixer and connected with said fluid supply passage, said blast port blasting the fluid flow, wherein the pressurized gas is supplied to said mixing space from a periphery of said blast port to thereby accelerate the fluid flow.

16. A method for forming a cleansing and/or scraping media flow comprising steps of:

blasting at least pressure fluid and pressure gas into a mixing space in a mixer at a high speed to thereby form a high speed mixture flow of said pressure fluid and said pressure gas;

sucking gas by an ejector effect based on said high speed mixture flow to thereby form a cleansing and/or scraping media flow containing fluid like droplets; and blast said cleansing and/or scraping media flow from a nozzle.

17. A method for forming a cleansing and/or scraping media flow according to claim 16, further comprising a step of heating at least one of said pressure gas and said pressure fluid before blasting step.

18. A method for forming a cleansing and/or scraping media flow according to claim 16, dividing said mixing space in said mixer into an upstream space and a downstream space by a partition wall having an aperture portion;

blasting said pressure fluid and said pressure gas at the high speed into said upstream space on an upstream side of said partition wall to thereby suck gas by an ejector effect based on said high speed mixture flow of said pressure fluid and said pressure gas;

supplying detergent to said downstream space on a downstream side of said partition wall; and blasting a cleansing and/or scraping media flow containing said gas, said droplet-like fluid and said detergent from said nozzle.

19. A method for forming a cleansing and/or scraping media flow according to claim 16, wherein treatment modes can be selected by changing at least one of supply conditions of said fluid, said gas, said powder and said detergent.

20. A method for forming a cleansing and/or scraping media flow comprising steps of:

blasting at least pressure fluid and pressure gas into a mixing space in a mixer at a high speed to thereby form a high speed mixture flow of said pressure fluid and said pressure gas;

sucking gas by an ejector effect based on said high speed mixture flow to thereby form a cleansing and/or scraping media flow containing fluid like droplets; and blast said cleansing and/or scraping media flow from a nozzle; and further comprising steps of:

dividing said mixing space in said mixer into an upstream space and a downstream space by a partition wall having an aperture portion;

blasting said pressure fluid and said pressure gas at the high speed into said upstream space on an upstream side of said partition wall to thereby suck gas by an ejector effect based on said high speed mixture flow of said pressure fluid and said pressure gas;

supplying powder to a desirable space in said mixer; and blasting said cleansing and/or scraping media flow containing said gas, said droplet-like fluid and said powder from said nozzle.

21. An apparatus for forming a cleansing and/or scraping media flow comprising:

a mixer having a mixing space formed with a blast port for blasting at least pressure fluid and pressure gas;

a gas supply pipe connected to said mixing space; and a nozzle connected to said mixing space, wherein gas is sucked from said gas supply pipe by an ejector effect based on a high speed mixture flow containing said pressure fluid and said pressure gas blasted through said blast port so that a cleansing and/or scraping media flow containing fluid like droplets is blasted from said nozzle.

22. An apparatus for forming a cleansing and/or scraping media flow according to claim 21, further comprising means for heating at least one of said pressure gas and said pressure fluid before supplying to said mixer.

23. An apparatus for forming a cleansing and/or scraping media flow according to claim 21, wherein said mixing space in said mixer is divided into an upstream space and a downstream space by a partition wall having an aperture portion, and at least said pressure fluid and said pressure gas are blasted at a high speed into said upstream space on an upstream side of said partition wall to thereby suck said gas by an ejector effect based on a high speed mixture flow of said pressure fluid and said pressure gas, while detergent is supplied to said downstream space on a downstream side of said partition wall so as to blast said cleansing and/or scraping media flow containing said gas, said droplet-like fluid and said detergent from said nozzle.

24. An apparatus for forming a cleansing and/or scraping media flow comprising:

a mixer having a mixing space formed with a blast port for blasting at least pressure fluid and pressure gas;

a gas supply pipe connected to said mixing space; and a nozzle connected to said mixing space, wherein gas is sucked from said gas supply pipe by an ejector effect based on a high speed mixture flow containing said pressure fluid and said pressure gas blasted through said blast port so that a cleansing and/or scraping media flow containing fluid like droplets is blasted from said nozzle; and wherein said mixing space in said mixer is divided into an upstream space and a downstream space by a partition wall having an aperture portion, and at least said pressure fluid and said pressure gas are blasted at a high speed into said upstream space on an upstream side of said partition wall to thereby suck said gas by an ejector effect based on a high speed mixture flow of said pressure fluid and said pressure gas, while powder is supplied to a desirable space in said mixer so as to blast said cleansing and/or scraping media flow containing said gas, said droplet-like fluid and said powder from said nozzle.

25. A cleansing and/or scraping apparatus comprising:

pressure fluid supply means;

mixing means for mixing a fluid and a gas;

a fluid supply passage connecting said pressure fluid supply means to said mixing means so as to blast a flow of fluid into said mixing means at a high speed;

a gas supply passage connected to said mixing means so as to supply the gas to said fluid flow which is blasted in said mixing means;

a powder supply passage connected to said mixing means so as to supply powder to said fluid flow which is blasted in said mixer to thereby form a mixture flow composed of said gas, fluid like droplets and said powder; and a nozzle for blasting said mixture flow at a high speed so that impact actions held by said powder and said droplet-like fluid as cleansing and/or scraping media are given to a surface to be treated so as to carry out a cleansing and/or scraping operation.

* * * * *